United States Patent [19]

Schmidt

[11] 4,249,620

[45] Feb. 10, 1981

[54] METHOD OF BORING HOLES WHICH ARE OPEN AT BOTH ENDS IN THE GROUND

[76] Inventor: Paul Schmidt, Winterberger Strasse, 5940 Lennestadt-Saalhausen, Fed. Rep. of Germany

[21] Appl. No.: 37,338

[22] Filed: May 9, 1979

[30] Foreign Application Priority Data

Jun. 7, 1978 [DE] Fed. Rep. of Germany ..... 2824915

[51] Int. Cl.[3] ..... E21B 7/26; E21B 7/28

[52] U.S. Cl. ..... 175/53; 175/19; 175/62; 405/184

[58] Field of Search ..... 175/19, 53, 20, 62, 175/293, 296; 405/184

[56] References Cited

U.S. PATENT DOCUMENTS

| | | | |
|---|---|---|---|
| 2,074,003 | 3/1937 | Templeton et al. | 175/53 X |
| 2,349,033 | 5/1944 | Elliott | 175/62 X |
| 2,746,719 | 5/1956 | Seligman | 175/53 |
| 2,837,324 | 6/1958 | Aschacker | 175/53 |
| 3,232,360 | 2/1966 | Dickinson | 175/62 |
| 3,396,807 | 8/1968 | Menton | 175/293 |
| 3,486,572 | 12/1969 | Hamilton et al. | 175/53 |
| 3,905,431 | 9/1975 | Hasewend | 175/53 |
| 4,117,895 | 10/1978 | Ward et al. | 175/53 |

FOREIGN PATENT DOCUMENTS

| | | | |
|---|---|---|---|
| 841600 | 7/1960 | United Kingdom | 405/184 |
| 1257285 | 12/1971 | United Kingdom . | |
| 1542541 | 3/1971 | United Kingdom . | |

*Primary Examiner*—Stephen J. Novosad

*Attorney, Agent, or Firm*—Toren, McGeady and Stanger

[57] ABSTRACT

A method of boring holes in the ground, which holes are open at both ends, includes forming an open-ended pilot bore by means of a first self-propelled displacement hammer of smaller diameter. Next a cable is introduced through the pilot bore and then the diameter of the pilot bore is increased to form the hole by means of a second displacement hammer of greater diameter. The second displacement hammer is guided through the pilot bore by pulling it with the cable which for this purpose is attached to the leading end of the second hammer.

5 Claims, 7 Drawing Figures

METHOD OF BORING HOLES WHICH ARE OPEN AT BOTH ENDS IN THE GROUND

This invention relates to methods of boring holes in the ground by means of a self-propelled displacement hammer, which holes are open at both ends.

Such ground bores, which may extend horizontally, vertically or at an inclination, are used, for example, in the connection of pipes from houses and other buildings to main drainage systems. In comparison with the laying of pipes in open trenches, trenchless laying by means of such bores has the advantage that in gardens, cultivated areas or roads, no expensive replacement or repaving operations are necessary and that such pipes can be laid straight through underneath fences and walls. For this purpose, a self-propelled displacement hammer is accurately aligned and drives itself percussively, being operated by compressed air, automatically through the ground. The pipes are pulled, for example, by a steel cable which is towed behind the hammer into the bore and may be additionally advanced by means of a tackle.

Although such trenchless laying of pipes has proved very satisfactory, difficulties frequently occur in achieving a sufficiently accurately aligned bore. These difficulties are dependent upon the nature of the ground, the type of pipes to be laid and other influences.

The object of the present invention is to provide a method of forming ground bores which extend accurately between two points.

To this end, according to this invention, we provide a method of boring holes in the ground, which holes are open at both ends, by means of a self-propelled displacement hammer, wherein an accurately aligned pilot bore of small diameter is first formed in advance of the displacement hammer, a cable is inserted through the pilot bore, then the diameter of the pilot bore is increased by means of the displacement hammer which is of larger diameter than the pilot bore, the displacement hammer being guided through the pilot bore by being pulled by the cable.

Because initially a pilot bore of small diameter is produced, a very much more accurate path of the final main hole can be achieved and moreover after the construction of the pilot bore it is possible to check whether this is sufficiently accurately aligned and to make corrections if necessary. A pilot bore of small diameter can be constructed with a displacement hammer very much more rapidly than a bore of larger diameter. If, therefore, the pilot bore is not correctly aligned towards the target and a new one has to be constructed, no great expense is required.

The accuracy of the main hole is assured by the fact that firstly the pilot bore extends with the correct alignment and secondly that the displacement hammer of greater diameter is pulled and thus guided by means of the cable introduced through the pilot bore, thus considerably improving the directional stability.

The cable is preferably pulled into the pilot bore by the pilot bore displacement hammer and for this purpose it can be secured either directly to the hammer or to the compressed air hose leading to the hammer. In the latter case the cable is not pulled completely through the pilot bore until the compressed air hose is pulled out from the bore after the bore has been completed.

To increase the directional stability of the pilot bore hammer, a follow-up extension pipe can be fixed to it. Pulling-in of a drainage pipe or underground cable, for example, in the main hole may with advantage be effected by the pipe or cable being attached to the rearward end of the displacement hammer of greater diameter. To damp the vibrations of the displacement hammer in the towed pipe or cable or to reduce these vibrations, the towed pipe or cable is preferably subjected to a compression force in the direction of advance.

A ground bore hole for a branch drain pipe can be constructed either before or after the laying of a main drain to which the branch is to be connected. In either case it is of advantage to construct a starting pit at which one open end of the hole is located using a shoring frame which is pressed into the ground and within which the ground is excavated. The pilot bore hammer is then lowered on a starting carriage into the starting pit and, after a flap in the shoring frame has been opened, the pilot bore is formed. The shoring frame permits simple anchoring of a device for subsequently pushing forward the towed tube and may be of such a size as to permit the displacement hammer to be lowered on a starting carriage with a concrete plinth into the pit. This makes any further anchorage in the ground unnecessary. A shoring frame can be used in a similar way for a target pit at the other open end of the hole.

An example of a method in accordance with this invention will now be described with reference to the accompanying diagrammatic drawings in which.

Figure 1:
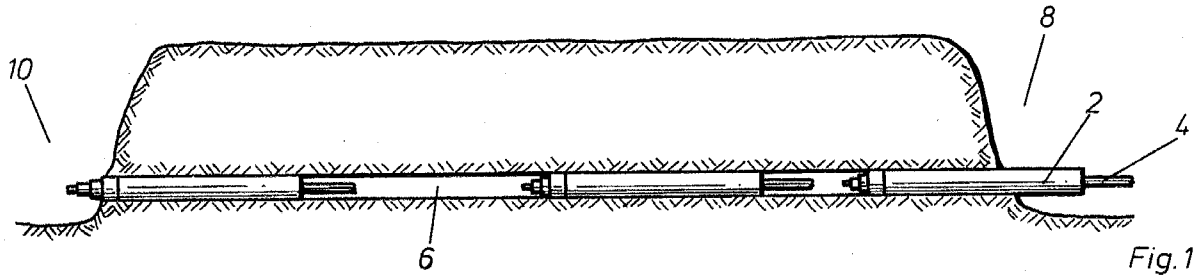
FIG. 1 is a longitudinal section showing the formation of a pilot bore.
Figure 2:
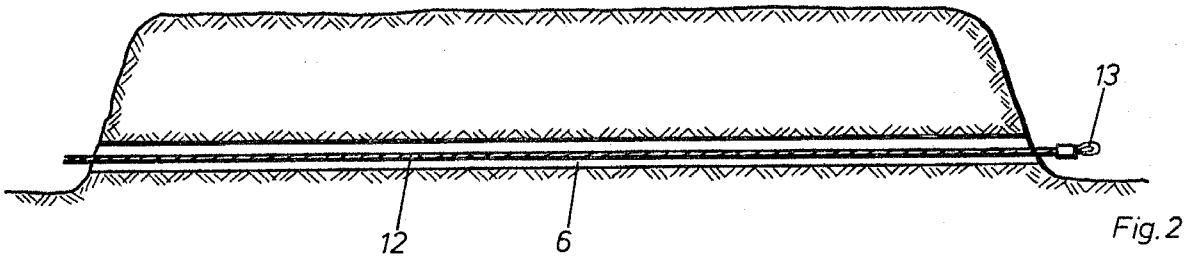
FIG. 2 is a similar section showing the pilot bore with a cable pulled through it.
Figure 3:
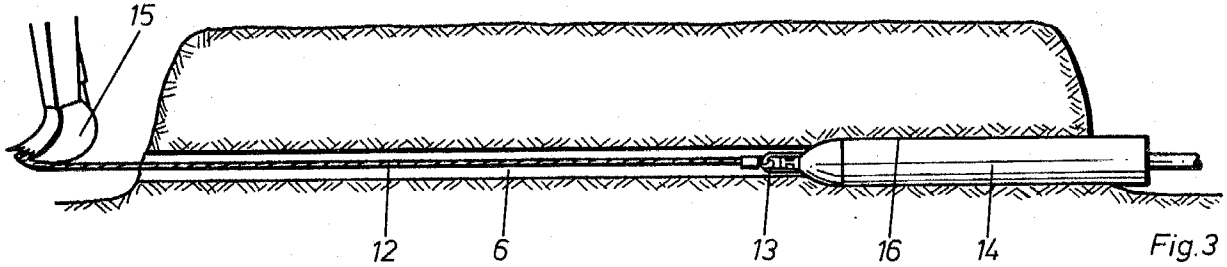
FIG. 3 is a similar section showing the widening of the pilot bore.
Figure 4:
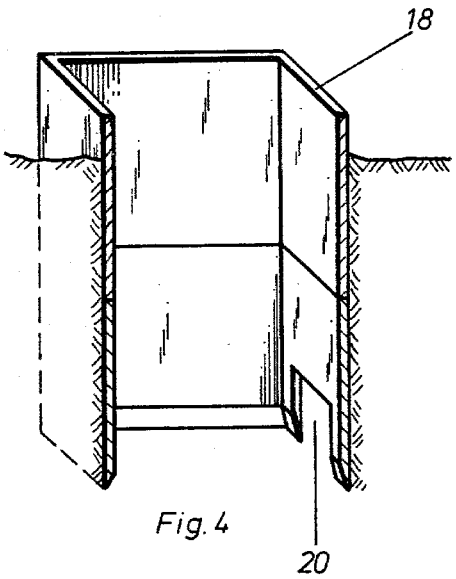
FIG. 4 is a sectional perspective view of a shoring frame.

Referring to FIGS. 1 to 3, a self-propelled, pneumatically operated displacement hammer 2 of relatively small diameter is driven from a starting pit 8 towards a target pit 10 through the ground, thus producing a pilot bore 6. The displacement hammer 2 is driven by compressed air, supplied through a hose 4. A steel cable 12 is attached directly to the displacement hammer 2 or to the hose 4. This cable extends, after the pilot bore 6 has been completed, through the pilot bore 6 in the manner shown in FIG. 2. The cable 12 is attached by a pulling shackle 13 to the nose of a widening-out displacement hammer 14 of greater diameter, which widens the pilot bore 6 out to the diameter of the main bore 16. In order to guide the widening-out hammer 14 accurately through the pilot bore 6, a pull is exerted on the steel cable 12, in this example by means of an excavator arm 15. The actual tunnelling work in the construction of the main bore 16 is, however, performed by the displacement hammer 14.

In very long bore holes it may be of advantage to provide the displacement hammer 2 for the pilot bore 6 with a follow-up extension pipe which is drawn by the hammer through the bore.

The construction of the branch drain pipes leading from individual buildings preferably takes place in advance of the main drain construction. At a point through which the main drain is to be laid later, a shoring frame 18, having sharpened cutting edges at its lower end, is pushed by an excavator arm into the ground and the space within the frame is excavated until it has reached the desired depth. Different depths of the pit can be attained by using add-on sections. After completion of the starting pit 8 or the target pit 10, a flap 20 in the shoring frame is lifted so that the bore can be commenced from this point or the displacement hammer can emerge from the bore hole after completion of the latter.

Figure 5:
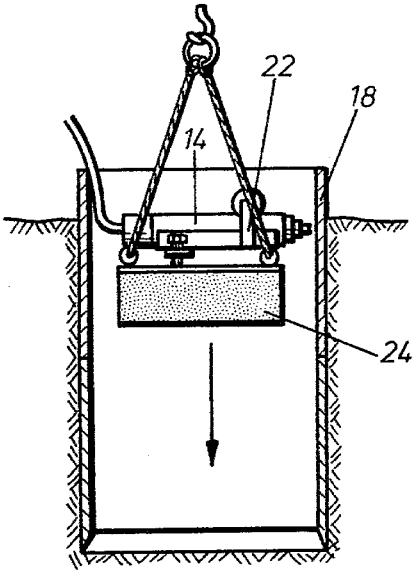
FIG. 5 shows the lowering of a displacement hammer into a pit shored by the frame shown in FIG. 4.
Figure 6:
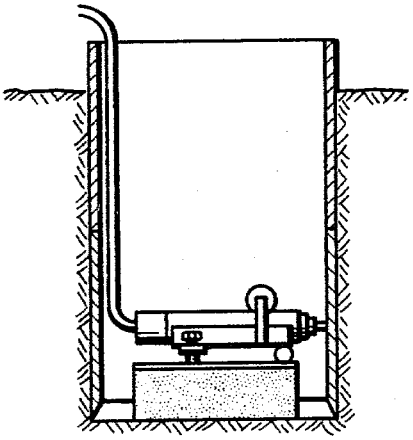
FIG. 6 shows the setting-up of the hammer in the pit for widening a pilot bore, extending from the pit; and, FIG. 7 shows the pulling and pushing of a pipe into the widened bore.
Figure 7:
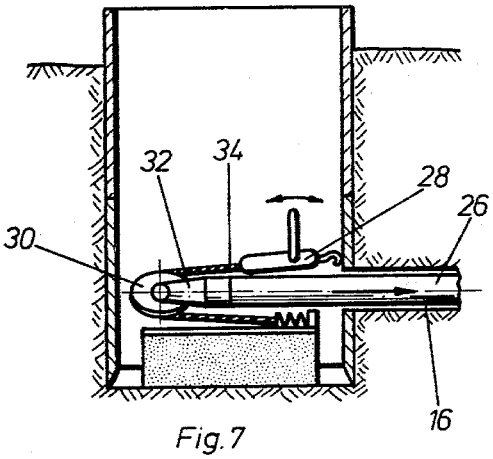

FIGS. 5 to 7 show the construction of the main bore. For this purpose, a displacement hammer 14 is fixed on a starting carriage 22 with a concrete plinth 24. The concrete plinth 24 together with the starting carriage 22 and the displacement hammer 14 are lowered by a crane into the starting pit 8 and, as shown in FIG. 6, the hammer is set in operation. As soon as the displacement hammer 14 has penetrated sufficiently far into the bore 16, a towed pipe 26 is fixed to its rear end and is subjected to a pushing force. For this purpose, a roller support 32 with a roller 30 is fixed to the rear end of the pipe, a cable 34 which is tensioned by means of a cable winch 28, being conducted around the roller. In this manner the vibrations of the displacement hammer 14 are damped or reduced in the towed pipe 26. The displacement hammer 14 is pulled by means of a cable 12 in the manner shown in FIG. 3, so that it follows accurately the direction of the pilot bore 6.

After the laying of the household branch drain pipes, a trench for the main drain is excavated; the main drain pipes are laid and are connected to the household branches.

If the household branches have to be constructed after the laying of the main drain, then at those points where the household branch connection is to be made, the shoring frame is introduced as far downwards as the laid main drain and from this point the boring is started. In this case, the household branch enters the main drain from above through an elbow bend.

I claim:

1. A method of boring holes, which are open at both ends, in the ground by means of a self-propelled displacement hammer, said method comprising the steps of first forming an accurately aligned pilot bore of relatively small diameter in advance of said displacement hammer, inserting a cable through said pilot bore, connecting one end of said cable to said displacement hammer and then causing said hammer to move through said pilot bore, said displacement hammer being of a greater diameter than said pilot bore whereby said pilot bore is increased in diameter, guiding said displacement hammer through said pilot bore by pulling displacement hammer through said bore by pulling on said cable and attaching a follow-up extension pipe to said displacement hammer of smaller diameter before said displacement hammer of smaller diameter forms said pilot bore.

2. A method of boring holes, which are open at both ends, in the ground by means of a self-propelled displacement hammer, said method comprising the steps of first forming an accurately aligned pilot bore of relatively small diameter in advance of said displacement hammer, inserting a cable through said pilot bore, connecting one end of said cable to said displacement hammer and then causing said hammer to move through said pilot bore, said displacement hammer being of a greater diameter than said pilot bore whereby said pilot bore is increased in diameter, guiding said displacement hammer through said pilot bore by pulling displacement hammer through said bore by pulling on said cable, forming said pilot bore by means of a further displacement hammer of smaller diameter and inserting said cable through said pilot bore by attaching said cable to said displacement hammer of smaller diameter before said pilot bore is formed by said displacement hammer of smaller diameter, whereby said cable is drawn through said pilot bore by said displacement hammer of smaller diameter, and attaching a pipe to said displacement hammer of greater diameter before said hammer of greater diameter is caused to move through said pilot bore and towing said pipe through said pilot bore as said pilot bore is increased in diameter by the passage of said displacement hammer of greater diameter.

3. A method as claimed in claim 2, further comprising the step of pushing said towed pipe in the direction of advance of said hammer of greater diameter through said pilot bore.

4. A method of boring holes, which are open at both ends, in the ground by means of a self-propelled displacement hammer, said method comprising the steps of first forming an accurately aligned pilot bore of relatively small diameter in advance of said displacement hammer, inserting a cable through said pilot bore, connecting one end of said cable to said displacement hammer and then causing said hammer to move through said pilot bore, said displacement hammer being of a greater diameter than said pilot bore whereby said pilot bore is increased in diameter, guiding said displacement hammer through said pilot bore by pulling displacement hammer through said bore by pulling on said cable, forming said pilot bore by means of a further displacement hammer of smaller diameter and inserting said cable through said pilot bore by attaching said cable to said displacement hammer of smaller diameter before said pilot bore is formed by said displacement hammer of smaller diameter, whereby said cable is drawn through said pilot bore by said displacement hammer of smaller diameter, constructing a staring pit at one open end of said hole by the steps of pressing a shoring frame into said ground, excavating said ground within said frame and subsequently lowering said displacement hammer of smaller diameter on a staring carriage into said staring pit, opening a flap in said shoring frame and staring the formation of said pilot bore with said displacement hammer of smaller diameter in ground exposed by the opening of said flap.

5. A method as claimed in claim 4, further comprising forming a target pit by the same steps as those by which said starting pit is formed.

* * * * *